US010807218B2

(12) United States Patent
Watson

(10) Patent No.: US 10,807,218 B2
(45) Date of Patent: Oct. 20, 2020

(54) LOCKING MECHANISM FOR USE WITH TUBING OR CASING TONGS

(71) Applicant: Thru Tubing Solutions, Inc., Oklahoma City, OK (US)

(72) Inventor: Brock Watson, Oklahoma City, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 625 days.

(21) Appl. No.: 15/024,678

(22) PCT Filed: Jul. 24, 2015

(86) PCT No.: PCT/US2015/042060
§ 371 (c)(1),
(2) Date: Mar. 24, 2016

(87) PCT Pub. No.: WO2016/014979
PCT Pub. Date: Jan. 28, 2016

(65) Prior Publication Data

US 2016/0236331 A1 Aug. 18, 2016

Related U.S. Application Data

(60) Provisional application No. 62/029,005, filed on Jul. 25, 2014.

(51) Int. Cl.
*B25B 13/50* (2006.01)
*B25B 13/58* (2006.01)

(52) U.S. Cl.
CPC ..... *B25B 13/505* (2013.01); *B25B 13/58* (2013.01)

(58) Field of Classification Search
CPC ... B25B 13/505; B25B 13/58; B25B 13/5041; B25B 13/5008; B25B 13/5016
(Continued)

(56) References Cited

U.S. PATENT DOCUMENTS

RE12,438 E * 1/1906 Fisher ..... B25B 13/505 81/90.5
917,440 A * 4/1909 Hughes ..... B25B 13/505 81/90.5

(Continued)

FOREIGN PATENT DOCUMENTS

JP 0685760 U 12/1994
JP 3037733 U 5/1997

OTHER PUBLICATIONS

PCT/US2015/042060; International Search Report and Written Opinion; dated Nov. 17, 2015; 11 pages.

*Primary Examiner* — Hadi Shakeri
(74) *Attorney, Agent, or Firm* — Hall Estill Law Firm

(57) ABSTRACT

A locking mechanism is described herein that is attachable to tubing or casing tongs to maintain the engagement of a clamping apparatus of the tubing or casing tongs with a tubular member using only the locking mechanism and the tubing or casing tongs. The tubing or casing tongs can also include a handle for supporting the clamping apparatus that engages the tubular member. The locking mechanism can include a pitman arm rotatably supported by the handle of the tubing or casing tongs. The locking mechanism also includes an adjustable sleeve slidably supported by the pitman arm and a tension arm rotatably supported by the adjustable sleeve to engage with the clamping apparatus.

6 Claims, 5 Drawing Sheets

(58) Field of Classification Search
USPC ..... 81/57.33, 57.35, DIG. 3
See application file for complete search history.

(56) References Cited

U.S. PATENT DOCUMENTS

| | | | | | |
|---|---|---|---|---|---|
| 1,504,964 | A | * | 8/1924 | Newland | B25B 13/505 24/517 |
| 1,630,822 | A | * | 5/1927 | Bessolo | B25B 13/52 81/65.4 |
| 2,339,760 | A | * | 1/1944 | Boynton | B25B 13/505 81/90.4 |
| 3,097,552 | A | * | 7/1963 | Kelley | E21B 19/161 81/90.5 |
| 3,988,952 | A | * | 11/1976 | Dirks | B25B 13/5016 81/126 |
| 4,380,941 | A | | 4/1983 | Petersen | |
| 4,422,218 | A | * | 12/1983 | Brasseux | B60P 7/0838 24/270 |
| 4,546,678 | A | * | 10/1985 | Stuckey | B25B 13/505 81/90.6 |
| 6,374,465 | B1 | * | 4/2002 | Dykstra | B25B 5/12 24/68 CD |
| 9,434,055 | B2 | * | 9/2016 | Tunningley | E21B 19/161 |
| 2007/0022849 | A1 | | 2/2007 | Poehlmann | |
| 2010/0148414 | A1 | | 6/2010 | Poole et al. | |

* cited by examiner

LOCKING MECHANISM FOR USE WITH TUBING OR CASING TONGS

CROSS-REFERENCE TO RELATED APPLICATIONS

The present application is a national stage application of a PCT application having International Application No. PCT/US2015/042060, filed Jul. 24, 2015, which claims priority to U.S. Provisional Application having U.S. Ser. No. 62/029,005, filed Jul. 25, 2014, which claims the benefit under 35 U.S.C. 119(e), the disclosure of which is hereby expressly incorporated herein by reference.

BACKGROUND OF THE DISCLOSURE

1. Field of the Invention

The present disclosure relates to a locking mechanism for use with tubing or casing tongs.

2. Description of the Related Art

Tubing or casing tongs (also referred to as 360° wrenches) (see FIG. 1) can be large, heavy and cumbersome to use. The tongs require a user to continually maintain control over the tongs whether the user is actively applying torque to tubing or casing via the tongs. Thus, the user of the tongs is not capable of engaging the tongs on tubing or casing and perform any other function while the tongs remain engaged on the tubing or casing.

Accordingly, there is a need for a way for a user of tubing or casing tongs to "lock" the tongs on the tubing or casing so that the tongs remain engaged on the tubing or casing to permit the user to perform some other function.

SUMMARY OF THE DISCLOSURE

The present disclosure is directed toward a locking mechanism attachable to tubing or casing tongs to maintain the engagement of a clamping apparatus of the tubing or casing tongs with a tubular member using only the locking mechanism and the tubing or casing tongs. The tubing or casing tongs can also include a handle for supporting the clamping apparatus that engages the tubular member. The locking mechanism can include a pitman arm rotatably supported by the handle of the tubing or casing tongs. The locking mechanism also includes an adjustable sleeve slidably supported by the pitman arm and a tension arm rotatably supported by the adjustable sleeve to engage with the clamping apparatus.

DETAILED DESCRIPTION OF THE DISCLOSURE

Figure 1:
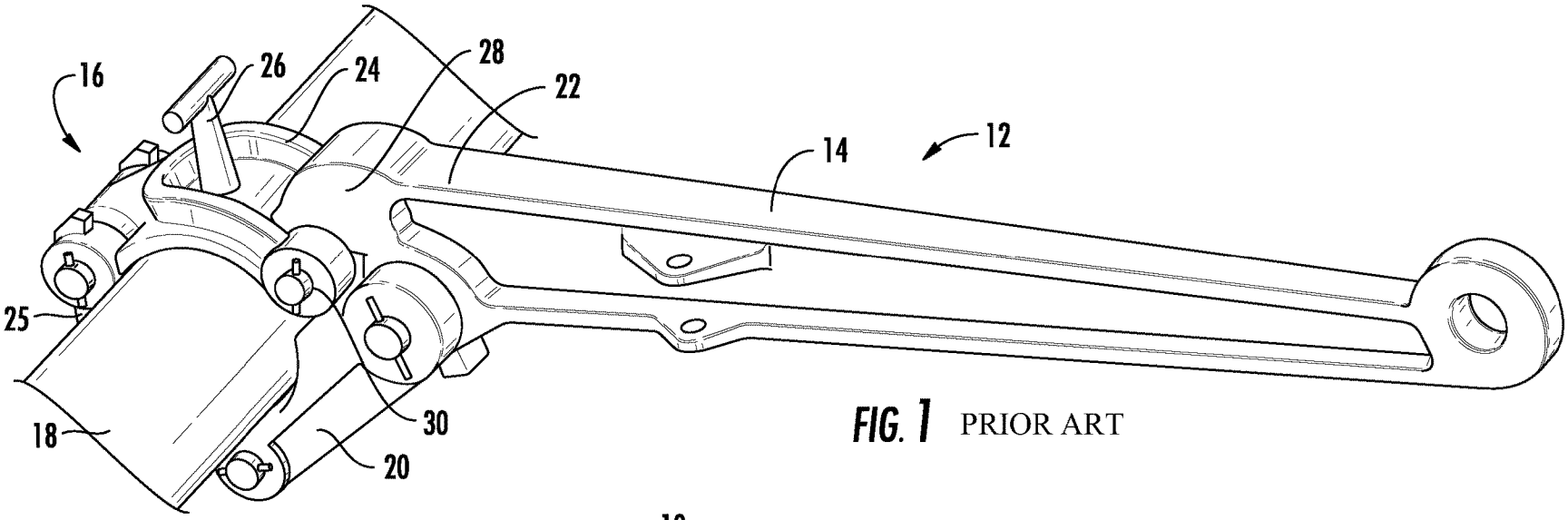
FIG. 1 PRIOR ART
FIG. 1 is a perspective view of tubing or casing tongs constructed in accordance with the present disclosure.
Figure 2:
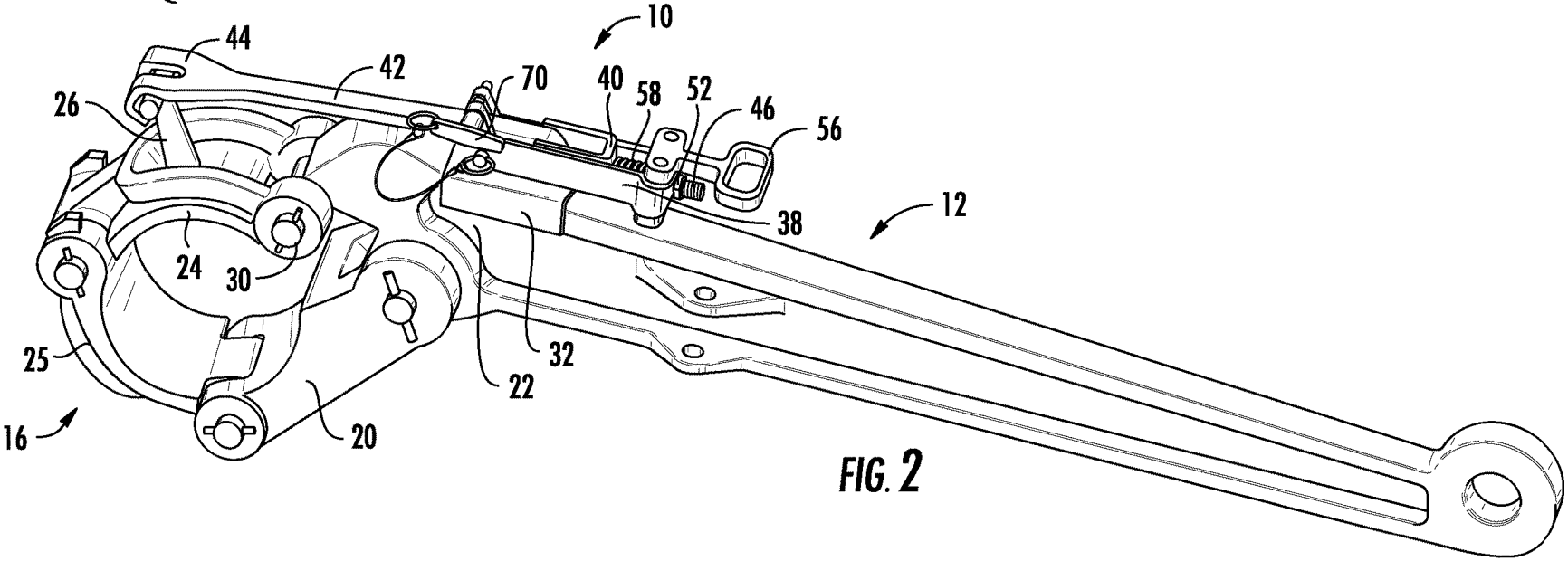
FIG. 2 is a perspective view of the tubing or casing tongs with a locking mechanism in a locked position constructed in accordance with the present disclosure.
Figure 3:
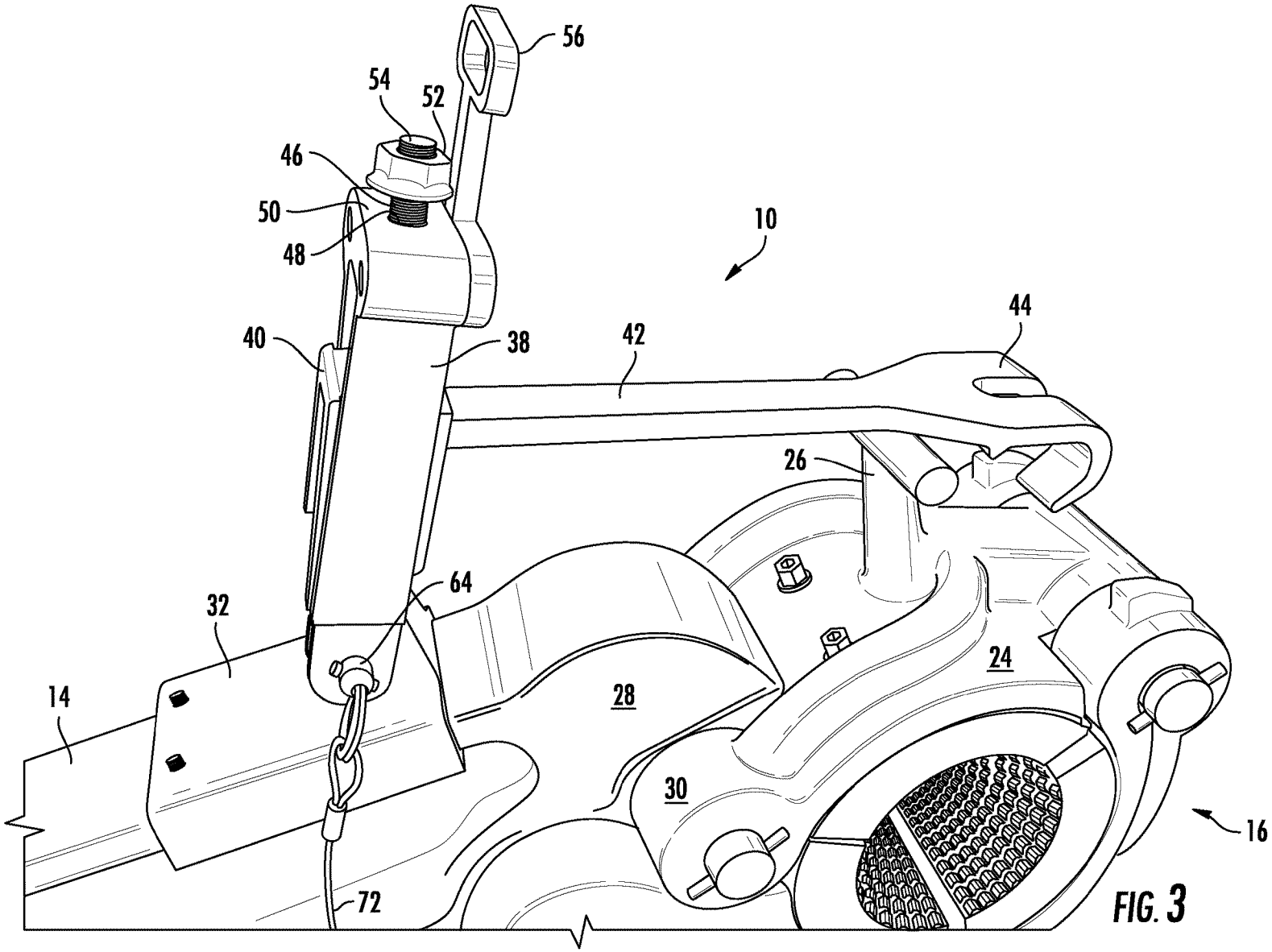
FIG. 3 is a perspective view of the tubing or casing tongs with the locking mechanism in an unlocked position constructed in accordance with the present disclosure.
Figure 4:
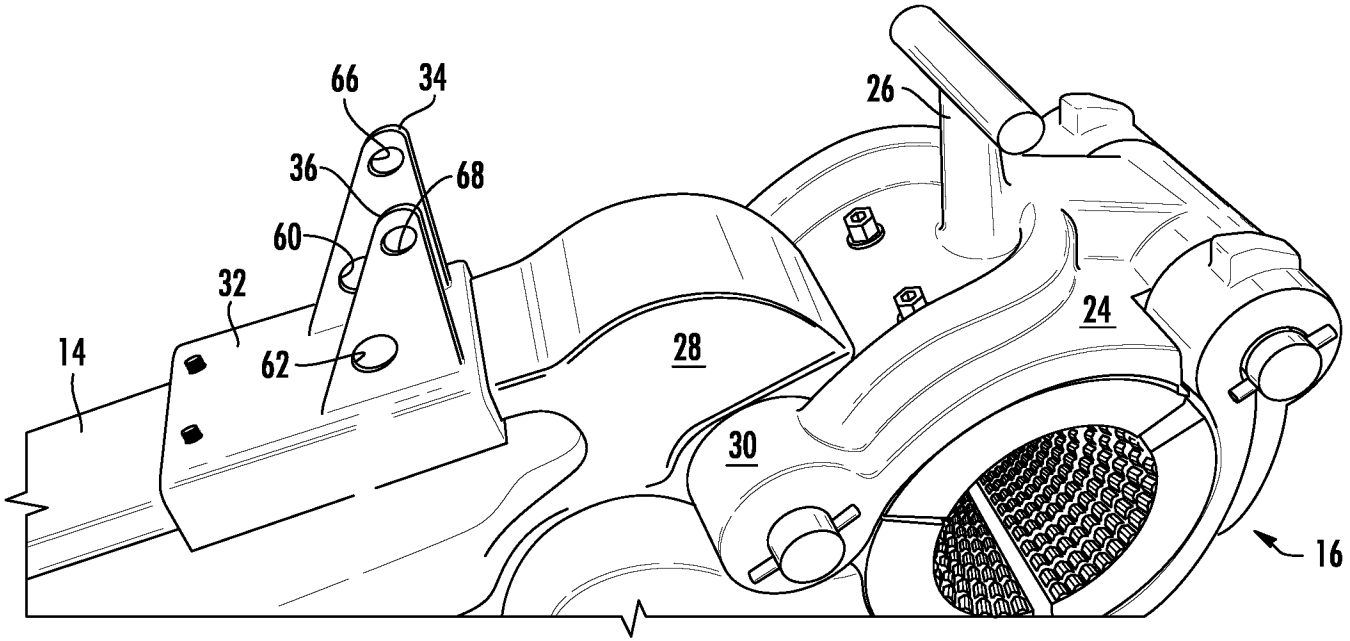
FIG. 4 is a perspective view of the tubing or casing tongs and a portion of the locking mechanism constructed in accordance with the present disclosure.
Figure 5:
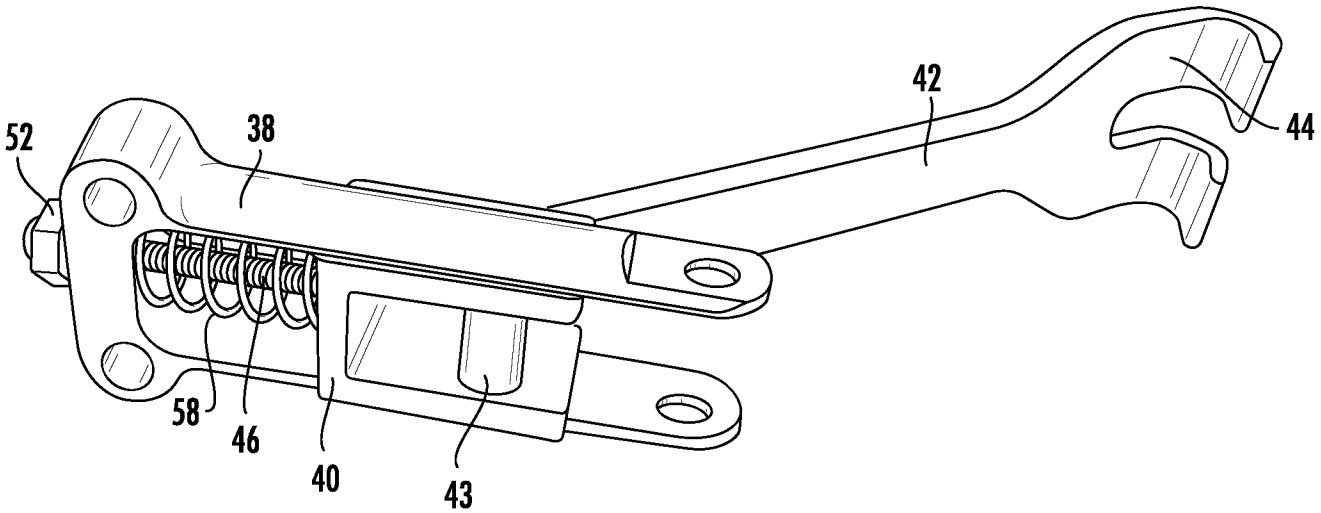
FIG. 5 is a perspective view of another portion of the locking mechanism constructed in accordance with the present disclosure.
Figure 6:
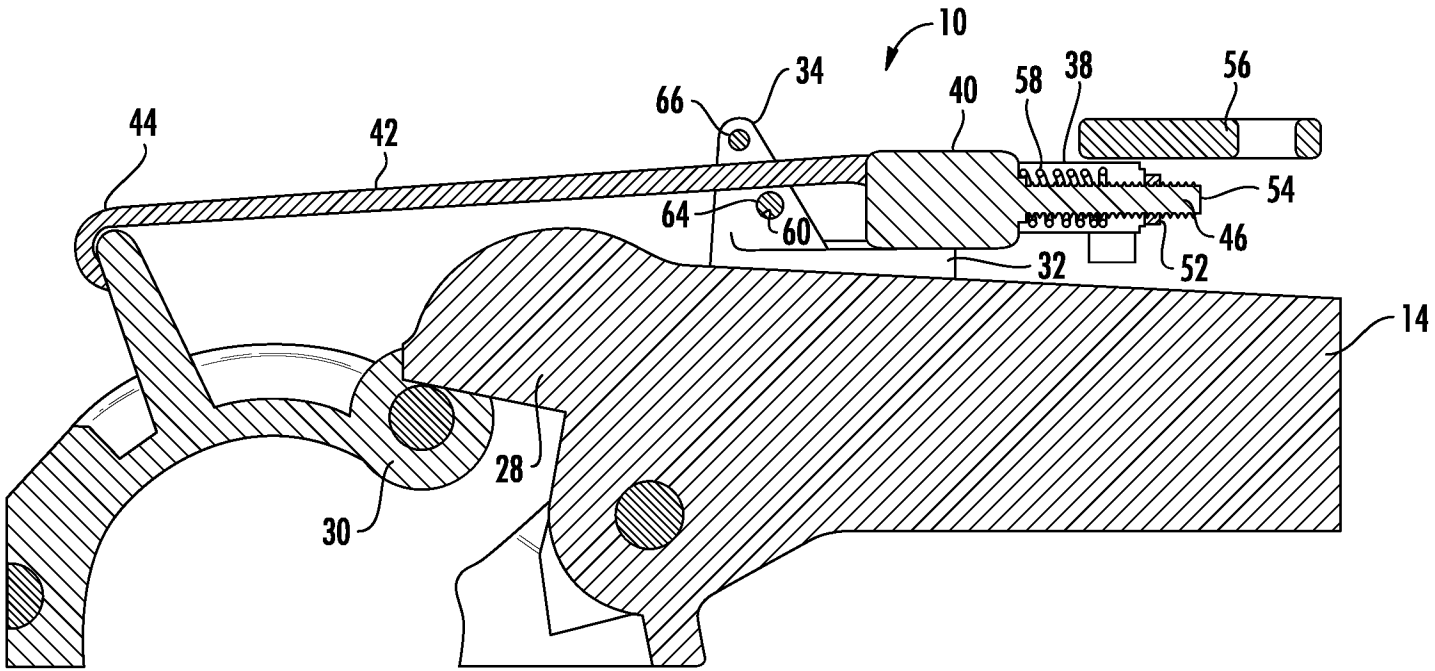
FIG. 6 is a cross-sectional view of a portion of the tubing or casing tongs and the locking mechanism constructed in accordance with the present disclosure.

The present disclosure relates to a locking mechanism 10 used in conjunction with tubing or casing tongs 12 (sometimes referred to as a 360° wrench). As shown in FIG. 1, tubing or casing tongs 12 typically include a handle 14 and a clamping apparatus 16 for wrapping at least partially around any type of tubular member 18. The clamping apparatus 16 includes a first clamping link 20 rotatably attached to a first end 22 of the handle 14, a second clamping link 24 rotatably attached to the first clamping link 20, and a force handle 26 for allowing a user to maintain the clamping apparatus 16 around the tubular member 18 before the user can apply enough force to the handle 14 to maintain the tongs 12 on the tubular member 18 and facilitate rotation of the tubular member 18. The clamping apparatus 16 can also include a third clamping link 25 rotatably attached to the first clamping link 20 and the second clamping link 24 and disposed between the first clamping link 20 and the second clamping link 24. The first end 22 of the handle 14 includes a leverage element 28 extending therefrom to engage with the second clamping link 24. The leverage element 28 forces the second clamping link 24, and ultimately the first clamping link 20, against the tubular member 18 as the user applies force to the handle 14 to rotate the tubular member 18.

The locking mechanism 10 can be any mechanism attachable to the handle 14 and engageable with the clamping apparatus 16 to maintain tension of the clamping apparatus 16 around the tubular member 18 or attachable to the clamping apparatus 16 and engagable with the handle 14 without the user having to manually supply the tension to the handle 14. In one embodiment, the locking mechanism can be disposed on an open side of the tongs 12. The open side of the tongs 12 is any side of the tongs 12 where the first clamping link 20 is not rotatably attached to the first end 22 of the handle 14.

In one embodiment shown in FIGS. 2-6, the locking mechanism 10 includes a bracket 32 attached to the handle 14 of the tubing or casing tongs 12 for supporting other components of the locking mechanism 10. The bracket 32 includes a first extension element 34 and a second extension element 36 that extend away from the bracket 32 in the opposite direction of the handle 14. The first extension element 34 and the second extension element 36 mirror each other.

The locking mechanism 10 can also include a pitman arm 38 (or pivot arm) rotatably supported by the first and second extension members 34, 36 attached to the bracket 32, an adjusting sleeve 40 slidably disposed relative to the pitman arm 38, and a tension arm 42 rotatably supported by the pitman arm 38 to selectively engage some portion of the clamping apparatus 16 of the tubing or casing tongs 12. The tension arm 42 can also be rotatably supported by the adjusting sleeve 40. A pin 43 (or pin-like structure) can be disposed through the adjusting sleeve 40 for one end of the tension arm 42 to be supported by. The tension arm 42 includes an engaging end 44 that can selectively engage the force handle 26 of the clamping apparatus 16. In one embodiment, the force handle 26 can have a t-shape and the engaging end 44 of the tension arm 42 can have a hook-shape to engage the force handle 26 with the t-shape. It should be understood and appreciated that the force handle 26 can be any shape and size and the engaging end 44 of the tension arm 42 can have any shape and size to be able to engage with the force handle 26. It should be understood and appreciated that the adjusting sleeve 40 is not limited by the term "sleeve". The adjusting sleeve 40 can have any shape and size such that it is adjustable relative to the pitman arm 38.

The locking mechanism 10 can also include a threaded shaft 46 extending from the adjusting sleeve 40 and through an opening 48 in a back portion 50 of the pitman arm 38. An adjustment device 52 threadably engagable with an end 54 of the threaded shaft 46 opposite of the adjusting sleeve 40 to adjust where the adjusting sleeve 40 is disposed relative to the pitman arm 38, the clamping apparatus 16, and/or the handle 14 of the tubing or casing tongs 12. The adjustment device 52 can be any type of device threadably engagable with the threaded shaft 46 such as a nut, wing nut, and the like.

In another embodiment of the present disclosure, the back portion 50 of the pitman arm 38 further includes a leverage handle 56 to help the user pivot and rotate the pitman arm 38 about its rotatable attachment to the first and second extension elements 34, 36 extending from the bracket 32 of the locking mechanism 10. In yet another embodiment, a spring 58 can be disposed around the threaded shaft 46 of the locking mechanism 10 and between the adjusting sleeve 40 and the back portion 50 of the pitman arm 38 to help stabilize the locking mechanism 10.

In a further embodiment of the present disclosure, the first extension element 34 includes at least one hole 60 in general alignment with at least one hole 62 disposed in the second extension element 36 for receiving a pivot pin 64 for the pitman arm 38 to rotate around. It should be understood and appreciated that while it is described herein in one embodiment that the pivot pin 64 is removable, the pivot pin 64 can be permanently affixed to the first and second extension elements 34, 36 of the bracket 32.

In yet another embodiment, the first extension element 34 of the bracket 32 further includes a second opening 66 in general alignment with a second opening 68 disposed in the second extension element 36 of the bracket 32 for receiving a safety pin 70. The safety pin 70 maintains the position of the tension arm 42 within the extension elements 34, 36 of the bracket 32 and below the second openings 66, 68 in the extension elements 34, 36. The safety pin 70 also prevents the tension arm 42 from slipping off its engagement with the clamping apparatus 16 and injuring the user of the tubing or casing tongs 12. The safety pin 70 can have a lanyard 72 attached thereto on one end of the lanyard 72 and the other end of the lanyard 72 can be attached to any other portion of the tubing or casing tongs 12.

In use, the user would extend the first clamping link 20 and second clamping link 24 around the tubular member 18 the user desires to rotate. The user then grabs the force handle 26 and moves the second clamping link 24 toward the first end 22 of the handle 14 to force an engagement end 30 of the second clamping link 24 between the tubular member 18 and the leverage element 28 of the handle 14. While force on the force handle 26 continues to be applied by the user, the user will rotate the handle 14 in the direction toward the force handle 26 to force the first clamping link 20 and the second clamping link 24 into and around the tubular member 18. Ultimately, the user can let go of the force handle 26 and maintain pressure on the handle 14, which maintains the clamping apparatus's grip on the tubular member 18.

Once the clamping apparatus 16 is positioned at the desired location on the tubular member 18, the pitman arm 38 is rotated away from the handle 14 of the tongs 12 to allow the engaging end 44 of the tension arm 42 to engage a portion of the clamping apparatus 16. In one embodiment, the engaging end 44 of the tension arm 42 engages the force handle 26 of the clamping apparatus 16. After the engagement of the clamping apparatus 16 by the engaging end 44 of the tension arm 42, the pitman arm 38 is rotated in a direction away from the clamping apparatus 16 to pull the clamping apparatus 16 tightly around the tubular member 18 via the tension arm 42. As the pitman arm 38 continues to rotate away from the clamping apparatus 16 and toward the handle 14 of the tongs 12, the tension arm 42 rotates about the pin 43 disposed in the adjustment sleeve 40.

If the adjustment sleeve 40 is positioned within the pitman arm 32 at a correct position, the pitman arm 38 is permitted to rotate substantially all the way to the handle 14 of the tongs 12 and the clamping apparatus 16 is securely disposed around the tubular member 18. As the pitman arm 38 is rotated toward the handle 14 of the tongs 12, the pitman arm 38 experiences resistance, or force opposing the rotation of the pitman arm 38 toward the handle 14. Once the pitman arm 38 is rotated a certain distance toward the handle 14 of the tongs 12, a break-over point is reached and the pitman arm 38 is now forced toward the handle 14 and would incur resistance if the pitman arm 38 was forced away from the handle 14 of the tongs 12. The forcing of the pitman arm 38 toward the handle 14 of the tongs 12, after the pitman arm 38 passes the break-over point, is what locks the tongs 12 in engagement with the tubular member 18.

If the pitman arm 38 is not able to rotate substantially close to the handle 14 of the tongs 12 or the pitman arm 38 is able to rotate substantially to the handle 14 of the tongs 12, but the clamping apparatus 16 is not securely fastened to the tubular member 18, then the position of the adjustment sleeve 40 needs to be adjusted relative to the pitman arm 38. In one embodiment, one way to determine if the pitman arm 38 is substantially close to the handle 14 of the tongs 12 is if the safety pin 70 can be disposed in the openings 66, 68 of the first and second extension elements 34, 36 above the tension arm 42.

The locking mechanism 10 has two areas of relative rotation. The first area of relative rotation is between the pitman arm 38 and the handle 14 of the tongs 12 and/or the bracket 32 of the locking mechanism 10. The second area of relative rotation is between the tension arm 42 and the adjustment sleeve 40.

In yet another embodiment of the present disclosure, the locking mechanism 10 can include the tension arm 42 engaging with the second clamping link 22 and the handle 14 of the tongs 12.

From the above description, it is clear that the present disclosure is well adapted to carry out the objectives and to attain the advantages mentioned herein as well as those inherent in the disclosure. While presently disclosed embodiments have been described for purposes of this disclosure, it will be understood that numerous changes may be made which will readily suggest themselves to those skilled in the art and which are accomplished within the spirit of the disclosure.

What is claimed is:

1. An apparatus, the apparatus comprising:

tubing or casing tongs having a handle and a clamping apparatus supported thereby to engage a tubular member, the clamping apparatus rotatably attached to the handle of the tubing or casing tongs at only a single location and extends entirely around the circumference of the tubular member; and a locking mechanism attached to the tubing or casing tongs to maintain the engagement of the clamping apparatus of the tubing or casing tongs with a tubular member using only the locking mechanism and the tubing or casing tongs, the locking mechanism has two areas of relative rotation and comprises:

a pitman arm rotatably supported by the handle of the tubing or casing tongs;

an adjustable sleeve slidably supported by the pitman arm; and a tension arm rotatably supported by the adjustable sleeve to engage with a force handle included with the clamping apparatus.

2. The apparatus of claim 1 wherein the clamping apparatus includes a first clamping link rotatably attached to a second clamping link that can engage a leverage element extending from one end of the handle of the tongs.

3. The apparatus of claim 1 wherein the two areas of relative rotation are between the pitman arm and the handle of the tongs, and between the tension arm and the adjustable sleeve.

4. The apparatus of claim 1 wherein the locking mechanism further includes a threaded shaft attached to the adjustment sleeve on one end and extends through a portion of the pitman arm on the other end to engage an adjustment device.

5. The apparatus of claim 1 wherein the force handle is t-shaped and the tension arm has a hook-shaped engaging end to engage the t-shaped force handle.

6. The apparatus of claim 1 wherein the locking mechanism further comprises a safety pin to maintain the tension arm in a locked position.

* * * * *